United States Patent [19]

Albers et al.

[11] 4,056,516

[45] Nov. 1, 1977

[54] MODACRYL FILAMENTS AND FIBERS AND PROCESS FOR THEIR MANUFACTURE

[75] Inventors: Ernst-August Albers, Bad Soden, Taunus; Walter Fester, Konigstein, Taunus; Bernd Sassenrath, Niedernhausen, all of Germany

[73] Assignee: Hoechst Aktiengesellschaft, Frankfurt am Main, Germany

[21] Appl. No.: 661,116

[22] Filed: Feb. 25, 1976

Related U.S. Application Data

[63] Continuation of Ser. No. 318,268, Dec. 26, 1972, abandoned.

[30] Foreign Application Priority Data

Dec. 28, 1971 Germany ..... 2164917

[51] Int. Cl.[2] ..... C08F 28/00

[52] U.S. Cl. ..... 260/79.3 M; 264/182; 264/210 F; 526/342

[58] Field of Search ..... 264/182, 210 F; 526/342; 260/79.3 M

[56] References Cited

U.S. PATENT DOCUMENTS

| | | | |
|---|---|---|---|
| 3,729,531 | 4/1973 | Suling et al. | 264/211 |
| 3,732,339 | 5/1973 | Suling et al. | 264/211 |
| 3,781,248 | 12/1973 | Sakai et al. | 260/793 M |
| 3,943,223 | 3/1976 | Kozuka et al. | 264/182 |

FOREIGN PATENT DOCUMENTS

| | | | |
|---|---|---|---|
| 42-13747 | 8/1967 | Japan | 264/182 |
| 45-2770 | 1/1970 | Japan | 264/182 |
| 47-38463 | 9/1972 | Japan | 264/182 |
| 47-34441 | 11/1972 | Japan | 264/182 |

*Primary Examiner*—Jay H. Woo
*Attorney, Agent, or Firm*—Curtis, Morris & Safford

[57] ABSTRACT

The invention relates to modacryl filaments and fibers made from copolymers insoluble in acetone of acrylonitrile and from 20 to 45 weight % of vinylidene chloride, containing from 0 to 1.5 weight % of unsaturated organic sulfonic acids or the salts thereof, and from 0 to 10 weight % of further copolymerizable compounds, which copolymers have a K value according to Fikentscher of from about 60 to about 90, and a process for the manufacture thereof. These modacryl filaments and fibers are especially distinguished by their permanent brilliance and permanent transparence; these properties are maintained even on contact with water having a temperature above 80° C.

5 Claims, No Drawings

MODACRYL FILAMENTS AND FIBERS AND PROCESS FOR THEIR MANUFACTURE

This is a continuation, of application Ser. No. 318,268 filed Dec. 26, 1972, now abandoned.

The present invention relates to modacryl filaments and fibers remaining brilliant and transparent on contact with water having a temperature of more than 80° C, made from high molecular weight copolymers that are insoluble in acetone, which copolymers are obtained by copolymerization of acrylonitrile and from 20 to 45 weight % of vinylidene chloride, and, optionally, up to 1.5 weight % of unsaturated organic sulfonic acids, and, optionally, up to 10 % of other usual comonomers, and which copolymers have K values according to Fikentscher of from about 60 to about 90; and a process for the manufacture thereof. Such modacryl filaments and fibers can be obtained by spinning of a spinning solution containing also a non-solvent for the polymer in addition to the polymer and a usual solvent, using three or more coagulation baths each having reduced contents of polymer solvent, the spinning tows obtained being drawn in at least one of these baths to a multiple of their length, and the practically solvent-free tows being subjected to at least one further drawing.

By modacryl filaments and fibers, according to the rules of the Federal Trade Commission of the U.S.A., there are to be understood those filaments and fibers the fiber-forming substance of which is a polymer containing less than 85 weight %, but more than 35 weight % of acrylonitrile.

In known processes, there are obtained modacryl filaments and fibers from copolymers of acrylonitrile and vinylidene chloride in the weight ratio as indicated which filaments and fibers, though being free from cavities visible under the microscope have the drawback of becoming opaque in hot, especially boiling, water. By becoming opaque there is to be understood the phenomenon of filaments or fibers losing their brilliance on account of diffuse light dispersion due to the formation of cavities in the fiber on contact with hot water. These pores have diameters near the wave length range of visible light. Filaments and fibers made from the cited polymers which are manufactured according to the present invention are stable to boiling and free from cavities. By "stable to boiling," there are to be understood those filaments and fibers which remain brilliant and transparent on contact with hot, especially boiling, water.

It is known to spin acrylonitrile/vinylidene chloride copolymers in a wet spinning process, for example from solutions in dimethyl formamide. The modacryl filaments and fibers so obtained, as compared to corresponding material made from polyacrylonitrile, have flame retarding properties, but on contact with water having a higher temperature than 80° C they lose their brilliance and become dull and non-transparent. This dullness may be removed by heating in dry air of more than 100° C or by treatment with concentrated salt solutions. But on renewed contact with hot water, this dullness reappears. Therefore, filaments and fibers not stable to boiling require special safety measures especially when they are dyed in aqueous baths at elevated temperature (cf. R. K. Kennedy in ManMade Fibers, Vol. 3 (1968), p. 227).

As a consequence of this lack of stability to boiling, non-brilliant dyeings are obtained, and in order to obtain the same color intensity more dyestuff is required than in the case of filaments or fibers stable to boiling. Moreover, the fastness to light of dyeings on opaque material is reduced. Therefore, the brilliancy and the transparence of the filaments or fibers must be restored by an appropriate after-treatment, which means not only an additional operation and thus more expenditure, but also the risk of uneven dyeings, since the dullness cannot be uniformly removed. A later renewed contact of these materials with hot water risks may again result in opaqueness and alteration of the color intensity.

According to British Pat. No. 1,102,576 it is known to prepare filaments and fibers stable to boiling from copolymers of acrylonitrile and vinylidene chloride in acetone by wet spinning from solutions in acetone. Copolymers having less than 45 weight % of vinylidene chloride and the filaments and fibers manufactured therefrom are insoluble in acetone. In the process as desired in the cited patent, filaments and fibers containing many large cavities are obtained, and therefore they cannot be used for certain textile applications. The stability to boiling of these textile materials can only be achieved by a storage of the spun filaments in water for several days in most cases, and a subsequent drawing.

Furthermore, some processes are known wherein solutions of acrylonitrile or modacryl polymers having an increased water content are obtained, and this content is reduced in a special process step before spinning these solutions. However, this spinning solution which is dehydrated for example by means of thin layer evaporators and then employed in the usual spinning processes does not yield filaments stable to boiling.

It has now been found that modacryl filaments and fibers made from acrylonitrile/vinylidene chloride copolymers insoluble in acetone, containing from 20 to 45 weight % of vinylidene chloride and up to 11.5 weight % of further copolymerizable compounds can be obtained by dissolving these copolymers having K values according to Fikentscher (definition cf. Cellulosechemie 13, 58 (1932)) of from about 60 to about 90 in a mixture of a usual solvent for acrylonitrile polymers, for example dimethyl formamide, dimethyl acetamide, dimethyl sulfoxide or ethylene carbonate, and a non-solvent for the polymer; and spinning this polymer solution in a special wet spinning process. This process comprises the use of several, at least three, coagulation baths having gradually reduced contents of polymer solvent, a drawing of the filaments to a multiple of their length in at least one of these baths, and at least one further drawing of the practically solvent-free filaments.

The K values according to Fikentscher indicated define the especially interesting range of mean molecular weights of the copolymers normally used for the manufacture of filaments and fibers. At a K value below the indicated range, filaments are obtained having reduced physical and textile properties. With increasing K value of the polymer used, the viscosity of the spinning solutions rapidly increases though the concentrations are the same. In order to ensure an optimum range of spinning viscosities, the polymer concentration of the spinning solution has to be correspondingly reduced. For this reason, at K values above 90 only relatively small polymer concentrations can be used, which cause a poor output of the spinning equipment employed for the manufacture of conventional modacryl filaments and fibers.

Suitable materials for the filaments and fibers stable to boiling in accordance with the present invention are copolymers insoluble in acetone of acrylonitrile and from 20 to 45 weight % of vinylidene chloride, containing optionally, in order to improve the dyestuff affinity, also up to 1.5 weight % of an unsatureated organic sulfonic acid, for example vinylsulfonic, allylsulfonic, methallylsulfonic, styrenesulfonic acid, or the salts thereof, and, optionally, up to 10 weight % of one or more further copolymerizable monomers, for example acrylic, methacrylic, α-chloro-acrylic acid, acrylic acid esters, such as methyl acrylate, ethyl acrylate, butyl acrylate, methoxy-methyl acrylate, α-chloro-ethyl acrylate, or corresponding esters of methacrylic and α-chloro-acrylic acid, methacrylic acid nitrile, acrylamide, methacrylamide or α-chloro-acrylamide or the N-alkyl or N,N-dialkyl derivatives thereof, vinyl carboxylates, such as vinyl acetate, vinyl propionate, vinyl stearate, trichloro-acetic acid vinyl ester, phosphonic acids, such as vinylphosphonic acid, allylphosphonic acid and the esters and salts thereof, tertiary amines, such as 2-vinylpyridine, 4-vinylpyridine, 2-methyl-5-vinylpyridine, vinylpiperidine, 2-dimethyl-amino-ethylmethacrylate, unsaturated dicarboxylic acids and the derivatives thereof, such as maleic or citraconic acid, maleic acid ester, N-alkyl- or N-aryl-maleic imides, styrene, vinylnaphthalene, vinyl chloride, vinyl bromide, vinyl fluoride, vinylidene fluoride, vinylidene bromide, 1-chloro-1-bromo-ethylene and other monoolefinically unsaturated copolymerizable monomers. The copolymers may be prepared in any manner, for example by discontinuous or continuous emulsion or suspension polymerization.

In order to improve one dyestuff affinity of acrylonitrile/vinylidene chloride copolymer filaments or fibers, additional monomers are used in the copolymerization which cause more steric hindrance than the nitrile group, and/or which contain acidic or basic groups in the molecule.

According to the process of the invention, the spinning solution contains also at least one non-solvent in addition to the solvent for the polymer. As non-solvent for the polymer, all those compounds or mixtures of compounds miscible with the polymer solvent used may be employed which, at higher concentration, cause precipitation of the polymer, for example water, aliphatic alcohols, such as methanol, ethanol, isopropanol, tertiary butanol; polyhydric alcohols, such as ethyleneglycol, glycerol; aromatic hydrocarbons, halogenated hydrocarbons, carboxylic acid esters, ethers, polyglycols etc. The amount of non-solvent for the polymer to be used depends on the nature of this non-solvent, the concentration of polymer in the solution, the polymer composition, the molecular weight of the polymer, and the coagulation conditions; in accordance with the invention, from 30 to 80%, preferably from 40 to 70% of that amount of non-solvent which would cause gelation of the solution at the spinning temperature is employed. When water is used as non-solvent, this is advantageous in that the polymer need not be completely dried, as is usual in the case of preparation by suspension-precipitation polymerization but may contain a certain residual moisture. It is advantageous to adjust a desired content of water in the spinning solution via the residual humidity of the polymer. For example, in the case where dimethyl formamide is employed as solvent and water as non-solvent, the process of the invention requires a water content of at least 5 weight % in order to yield products stable to boiling.

The spinning solutions are for example prepared as follows: the pulverulent copolymer is suspended at a temperature below 5° C in a mixture of dimethyl formamide and water, and dissolved with agitation at room temperature; if necessary, the solution is heated. Advantageously, the polymer concentration is determined in such a way as to impart to the spinning solution a viscosity of from 100 to 500 poise at the desired spinning temperature. These spinning solutions may also contain stabilizers, optical brighteners, dyestuffs or dulling agents.

The homogeneous spinning solution so obtained for example, is degased in a suitable manner and then forced through a spinning nozzle into a first coagulation bath, which has a temperature of from 0° to 70° C, preferably from 20° to 40° C, and contains a mixture of a solvent and a non-solvent for the polymer. The tow just spun is introduced into a second coagulation bath having a temperature in the same range as the first bath and also containing a mixture of solvent and non-solvent for the polymer. The content of polymer solvent in the first coagulation bath exceeds that of the second coagulation bath by about 1.2 to 2.0 times, preferably 1.4 to 1.8 times.

The composition of the coagulation baths depends on the nature of the solvent and non-solvent, and on the desired coagulation speed; for the first bath it is for example from 50 to 70 weight % of dimethyl formamide in water or from 30 to 50 weight % of dimethyl formamide in methanol. The tows spun are generally drawn off the coagulation bath at a speed less than the speed of the spinning solution emerging from the nozzle. After having left the second spinning bath, the tow is passed on to a third coagulation bath having a temperature of from 20° to 90° C, preferably from 40° to 80° C, and a content of solvent reduced by a factor of from 1.2 to 3 as compared to that of the second coagulation bath. The tow may then be conveyed to further coagulation baths having the same temperature as the third bath, the polymer solvent concentration of which, however, is reduced by a factor of from 1.2 to 3 in each case. In at least one of these baths, the tow is drawn to a total 2- to 6-fold its original length. Subsequently, the content of solvent of the filament is reduced to 0.2 weight % by thorough washing, and the filament is then subjected to a further drawing to a 1.1- to 2-fold of its length. This second drawing can be carried out in a hot non-solvent, hot steam, hot air, on a flat iron or by means of heatable godets; optionally this drawing may be done in several steps.

The spinning tows so obtained are after-treated as usual, for example by application of a suitable finish and a subsequent drying. By setting the filaments, preferably with free shrinkage, the textile properties are improved. In the case where staple fibers are manufactured, the latter process steps may be carried out before or after the spinning tows are cut.

The stability to boiling is examined by two different methods. First a comparison is carried out by a microscopic 120-fold magnification of samples boiled in water and dried at 60° C and untreated samples. In the case of filaments or fibers stable to boiling, there is no difference before and after boiling; in the case of products not stable to boiling, the filaments or fibers treated with boiling water look grey to black in transmitted light.

Second, the remission power at 4200 A of samples is compared, which samples are dyed for 2 hours at boiling temperature with 5% of Remacryl Blue RL (C.I. Basic Blue 22); one sample being dried at 60° C and the other at 125° C. Fibers and filaments are considered stable to boiling of the relative difference in their remission power does not exceed 3%. In the case of products not stable to boiling, the sample dried at 125° C has less remission power than that dried at 60° C, since the opaqueness of the material is removed by the drying at 125° C, while it is maintained when the material is dried at 60° C.

The following examples illustrate the invention. All percentages indicated are by weight.

EXAMPLE 1

A 23% spinning solution is prepared using a copolymer of 60% of acrylonitrile and 40% of vinylidene chloride having a K value of 86, prepared by suspension-precipitation polymerization, and a solvent mixture of 92% of dimethyl formamide and 8% of water. The degased spinning solution is forced through a nozzle having 100 holes of a diameter of 70 μm at a rate of 3.3 $cm^3$/min. into a first coagulation bath having a length of 60 cm, containing a mixture of 65 % of dimethyl formamide and 35% of water having a temperature of 25° C. Without an intermediate conveying device, the spinning tow obtained is passed on to a second coagulation bath having also a length of 60 cm, containing 40% of dimethyl formamide and 60% of water at a temperature of also 25° C. The spinning tow is then drawn off the second coagulation bath by means of a draw-off roller at a speed of 4m/min., passed on to a third bath containing 20% of dimethyl formamide and 80% of water of a temperature of 60° C, drawn three times its length by means of a further draw-off roller, washed with water of 90° C, dried and finally drawn two times its length at 120° C on a pair of rollers. The filament so obtained is steamed for 15 minutes in steam of 110° C with free shrinkage, and it then has the following properties:

titer: 363 dtex
tensile strength: 3.5 g/dtex
elongation at break: 25%

The filaments obtained have a very good whiteness degree, high brilliancy and complete transparency. At a 120-fold magnification under the microscope, a material boiled in water for 1 hour shows no difference as compared to an unboiled material. Both samples are transparent and free from cavities. A product dyed with Remacryl Blue RL at boiling temperature and dried at 60° C has a remission power at 4200 of 33.3%, and a product dried at 125° C has a remission power of 33.1% under these conditions. The filaments obtained are therefore stable to boiling.

COMPARATIVE EXAMPLE A

A spinning solution according to Example 1 is spun under the same conditions into a coagulation bath containing 65% of dimethyl formamide and 35% of water, but after 20 cm of immersion in the bath it is drawn off this coagulation bathf and drawn in a drawing bath containing also 65% of dimethyl formamide and 35% of water. All further conditions are as in Example 1. The filament obtained has the following properties:

titer: 367 dtex
tensile strength: 2.5 g/dtex
elongation at break: 19%

The filaments obtained are transparent and brilliant; at a 120-fold magnification under the microscope, no cavities are observed. On boiling in water, these filaments however become dull and opaque. Under the microscope, a filament so treated looks black in transmitted light. Samples dyed with Remacryl Blue RL and dried at 60° C and 125° C give the following remission values:

dried at 60° C: 44.0%
dried at 125° C: 36.3%

The filaments obtained thus are not stable to boiling.

COMPARATIVE EXAMPLE B

A 23% spinning solution of the copolymer used in Example 1 is prepared employing pure dimethyl formamide, and it is spun as indicated in Example 1. Filaments having the following properties are obtained:

titer: 365 dtex
tensile strength: 1.3 g/dtex
elongation at break: 17%.

The filaments are transparent and brilliant, but become opaque and loose their brilliancy on boiling in water.

At 120-fold magnificaton under the microscope, filaments untouched by hot water have no cavities and pores. Filaments treated in boiling water, however, look black in transmitted light under the microscope. As to the remission power of samples dyed with Remacryl Blue RL and dried at different temperature, the following data are obtained:

60° C dried: 41.4%
125° C dried: 35.2%

The filaments obtained thus are not stable to boiling.

EXAMPLE 2

A copolymer of 60% of acrylonitrile and 40% of vinylidene chloride having a K value of 65 is dissolved in a mixture of 89% of dimethyl formamide and 11% of water to form a 30% spinning solution. The degased spinning solution is spun as indicated in Example 1; the filaments obtained are transparent, pore-free, stable to boiling and have the following properties:

titer: 474 dtex
tensile strength: 2.5 g/dtex
elongation at break: 25%

Remission values of samples dyed with Remacryl Blue RL:

60° C dried: 32.8%
125° C dried 32.6%

EXAMPLE 3

A copolymer according to Example 1 is dissolved in a mixture of 75% of dimethyl formamide and 25% of methanol to form a 23% spinning solution. This solution is spun through a nozzle having 60 holes of a diameter of 80 μm into a first coagulation bath having a length of 80 cm, and containing 35% of dimethyl formamide and 65% of methanol at a temperature of 40° C. The filaments obtained are conveyed to a second spinning bath having a length of 40 cm and containing 25% of dimethyl formamide and 75% of methanol at a temperature of 40° C. After having left this second bath, the filaments are passed over a draw-off roller at a speed of 5 m/min. and conveyed to a third coagulation bath containing 15% of dimethyl formamide and 85% of methanol at a temperature of also 40° C. The spinning tow is drawn in this bath to a 4.8-fold of its original length and, after having passed over further conveyors, washed with water of 90° C, again drawn to a 1.25-fold of its length also in water of 90° C, dried and a third time drawn over a flat iron having a temperature of 140° C for a further 6.5%.

After steaming (15 minutes at 110° C), brilliant, transparent, pore-free filaments stable to boiling and having the following properties are obtained:

titer: 625 dtex
tensile strength: 2.3 g/dtex
elongation at break: 30%

Remission values of samples dyed with Remacryl Blue RL:

60° C dried: 27.7%
125° C dried: 27.5%

EXAMPLE 4

A copolymer composed of 74.2% of acrylonitrile, 20.0% of vinylidene chloride, 5.0% of acrylic acid methyl ester and 0.8% of sodium methallyl-sulfonate having a K value of 84, is dissolved in a mixture of 93% of dimethyl formamide and 7% of water to form a 24% spinning solution, which is spun, after degasing, according to Example 1. Brilliant, transparent, pore-free filaments having a good whiteness degree and the following properties are obtained:

titer: 361 dtex
tensile strength: 2,6 g/dtex
elongation at break: 28%

Remission values of samples dyed with Remacryl Blue RL:

60° C dried: 37.4%
125° C dried: 37.5%

The filaments obtained are stable to boiling.

What is claimed is:

1. A process for the manufacture of modacryl filaments and fibers from an acetone-insoluble copolymer of acrylonitrile, 20 to 45 weight percent of vinylidene chloride and up to 11.5 weight percent of further copolymerizable compounds, said copolymer having a K value of from about 60 to about 90, which comprises dissolving the copolymer in a mixture of a solvent for the polymer and a non-solvent for the polymer to form a spinning solution, the amount of non-solvent being from about 30 to 80% of the amount of non-solvent which would cause gelation of the spinning solution at the spinning temperature, forcing the spinning solution so obtained through nozzles into the first of at least three series-connected coagulation baths containing mixtures of said polymer solvent and said polymer non-solvent, the polymer solvent concentration in the first coagulation bath being from 30 to 70% by weight of said bath and being gradually reduced in successive coagulation baths, the polymer solvent concentration in the first coagulation bath being about 1.2 to 2.0 times that of the second coagulation bath, the polymer solvent concentration in each coagulation bath subsequent to the second bath being reduced by a factor of about 1.2 to 3 in each such subsequent bath, the temperatures of the first and second coagulation baths being from 0° to 70° C. and those of the third and the following baths from 20° to 90° C., drawing the spinning tows obtained to a multiple of their length in at least one of these baths, and, after removal of the solvent as completely as possible, subjecting said drawn tows to at least one further drawing.

2. A process as claimed in claim 1 wherein a total of three coagulation baths are employed.

3. A process as claimed in claim 1 wherein dimethyl formamide is used as polymer solvent and water as the non-solvent.

4. A process as claimed in claim 1 wherein dimethyl formamide is used as the polymer solvent and methanol as the non-solvent.

5. Modacryl filaments and fibers that retain their luster in contact with water at a temperature above 80° C., said filaments being made by the process of claim 1 from an acetoneinsoluble copolymer of acrylonitrile, 20 to 45 weight percent of vinylidene chloride, 0 to 1.5 weight percent of unsaturated organic sulfonic acid or salt thereof and from 0 to 10 weight percent of one or more other copolymerizable compounds, said copolymer having a K value of 60 to 90.

* * * * *